US005133676A

United States Patent [19]

Hutchison et al.

[11] Patent Number: 5,133,676

[45] Date of Patent: Jul. 28, 1992

[54] IMPEDANCE MATCHED RF SPRING CONTACT

[75] Inventors: Stephen J. Hutchison, Coral Springs; David H. Karl, Tamarac; David H. Minasi, Plantation, all of Fla.

[73] Assignee: Motorola, Inc., Schaumburg, Ill.

[21] Appl. No.: 710,628

[22] Filed: Jun. 5, 1991

[51] Int. Cl.[5] ..... H01R 9/09; H01R 17/04

[52] U.S. Cl. ..... 439/581; 333/33; 333/260; 439/916

[58] Field of Search ..... 439/63, 581, 916; 333/21 R, 33, 260, 34, 246

[56] References Cited

U.S. PATENT DOCUMENTS

| | | | |
|---|---|---|---|
| 3,899,231 | 8/1975 | Bray | 439/876 |
| 3,946,390 | 3/1976 | Alexander et al. | 343/702 |
| 4,611,186 | 9/1986 | Ziegner | 333/33 |
| 4,636,015 | 1/1987 | Ford, Jr. | 439/95 |
| 4,656,441 | 4/1987 | Takahashi | 439/63 |
| 4,690,471 | 9/1987 | Marabotto et al. | 439/63 |
| 4,842,527 | 6/1989 | Tellam | 439/63 |

*Primary Examiner*—Neil Abrams
*Attorney, Agent, or Firm*—Juliana Agon

[57] ABSTRACT

An RF interconnect assembly includes a ground plane (124) and a radio circuit (109), and an RF connector (126) having a signal conductor (127) and a ground conductor (130) where the ground conductor (130) is coupled to the ground plane (124). Located a predetermined distance (d) above the ground plane (124), a spring contact (140) provides a constant impedance transmission line connection between the RF connector (126) and the radio circuit (109).

10 Claims, 2 Drawing Sheets

IMPEDANCE MATCHED RF SPRING CONTACT

BACKGROUND OF THE INVENTION

This invention relates to the field of electrical interconnects and more particularly to radio frequency (RF) interconnects that find application in radio transceivers.

Radio transceivers usually include a main printed circuit board (PCB) attached to a metal frame or casting. An external antenna is typically attached directly to the RF input/output (i.e. antenna terminal or connector) of the radio transceiver.

In the past, coaxial cable has been used to provide a constant impedance, such as a 50 Ohm impedance between the printed circuit board and the antenna terminal. However, the use of coaxial cable creates problems in the manufacture of the radio transceiver because it requires a separate soldering and wire stripping operation which is usually done by hand.

It would therefore be desirable to have an interconnect or RF contact that could be entirely machine assembled to offer a more economical alternative, has the characteristic impedance of the design, and allows for ease of assembly and self alignment. Because of inherent dimensional manufacturing tolerances between the antenna terminal or connector and the frame or casting assembly with the attached printed circuit board, it would thus be advantageous if this interconnect or RF contact could compensate for any misalignment between the antenna terminal and the frame assembly, while still maintaining good electrical contact when assembled but could also be easily disassembled.

SUMMARY OF THE INVENTION

Briefly, according to the invention, an RF interconnect assembly includes a ground plane and a radio circuit, and an RF connector having a signal conductor and a ground conductor where the ground conductor is coupled to the ground plane. Located a predetermined distance above the ground plane, a spring contact provides a constant impedance transmission line connection between the RF connector and the radio circuit.

DESCRIPTION OF THE PREFERRED EMBODIMENT

Figure 1:
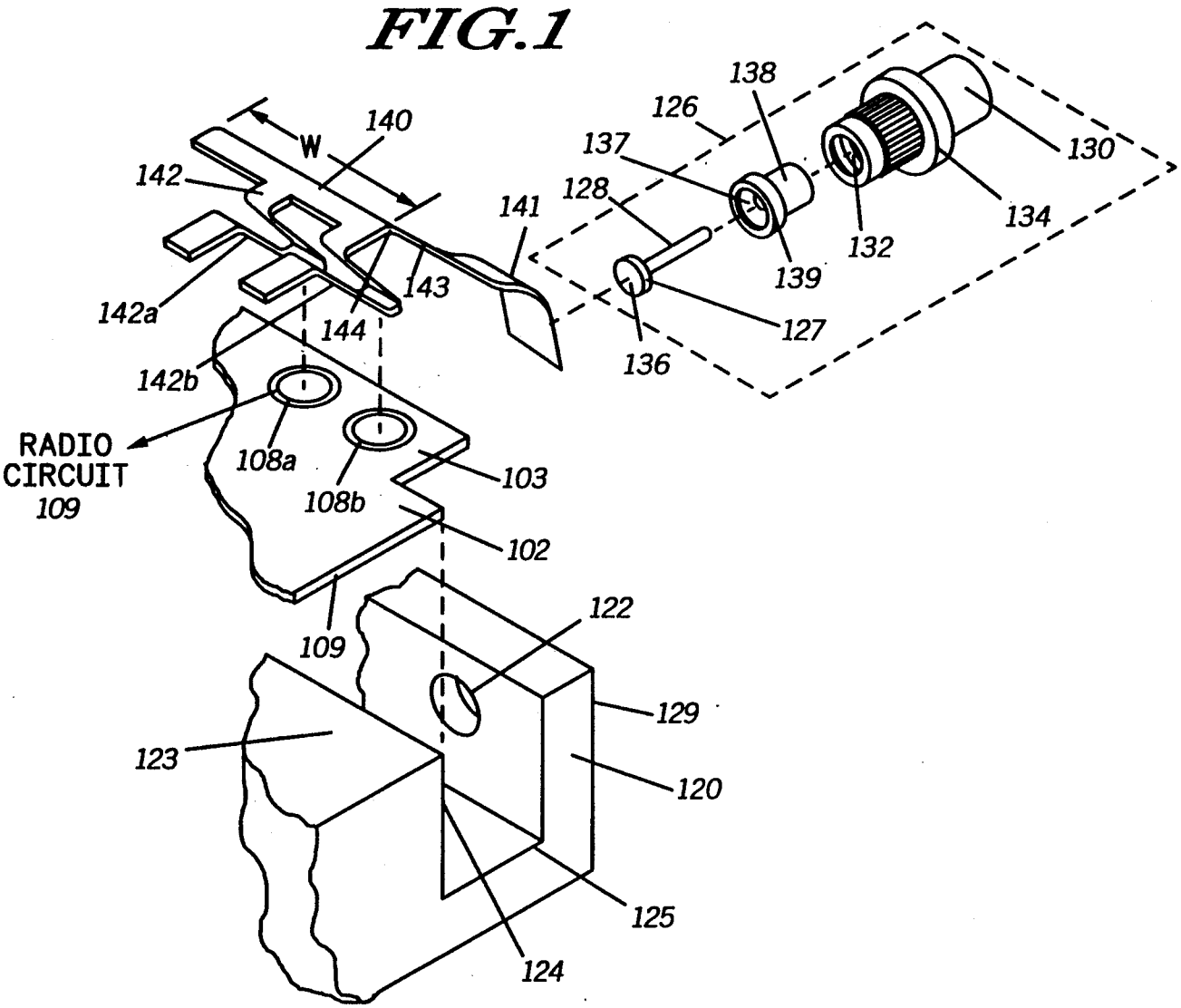
FIG. 1 is an exploded perspective view of the RF interconnect assembly in accordance with the present invention.

Referring to FIG. 1, a circuit substrate 102, preferably a printed circuit board (PCB), has at least one plated through-hole on a projection 103 of the PCB. Two plated through-holes, 108*a* and 108*b* are shown in this example for better mechanical support, however, more or less holes can be used as necessary. An electrical circuit pattern (not illustrated but is labeled radio circuit 109) is printed on one or both surfaces of the printed circuit board 102. The electrical circuit pattern is appropriately connected to the plated through-holes 108*a* and 108*b*.

A frame or casting 120 is preferably molded from metal. The casting 120 has an aperture 122 on a top surface 129. An antenna terminal or connector, or any other RF connector 126 has an antenna contact pin 127 comprising an inner conductor 128 connected to a pin head or pin contact 136 to form a signal or hot RF conductor, and an outer conductor or antenna bushing 130 to form a ground conductor. The outer conductor 130 has a recessed portion 132 and a flange 134. The aperture 122 in the casting 120 is sized to receive the outer conductor or antenna bushing 130. Hence, one function of the flange 134 is to properly position the antenna terminal 126 and the aperture 122. In between the inner conductor 128 and the outer conductor 130 is a dielectric or insulator 138 having a flange 139, surrounding a recessed portion 137. Upon assembly, the projecting contact or pin head 136 will extend beyond the edges of the outer conductor 130 and the insulator 138, since the flange 139 of the insulator 138 will rest within the recessed portion 132 of the antenna bushing 130, while part of the pin contact head 136 will rest within the recessed portion 137 of the insulator 138 and the remaining portion of the contact head 136 will extend beyond the flange 139 of the insulator 138.

Figure 2:
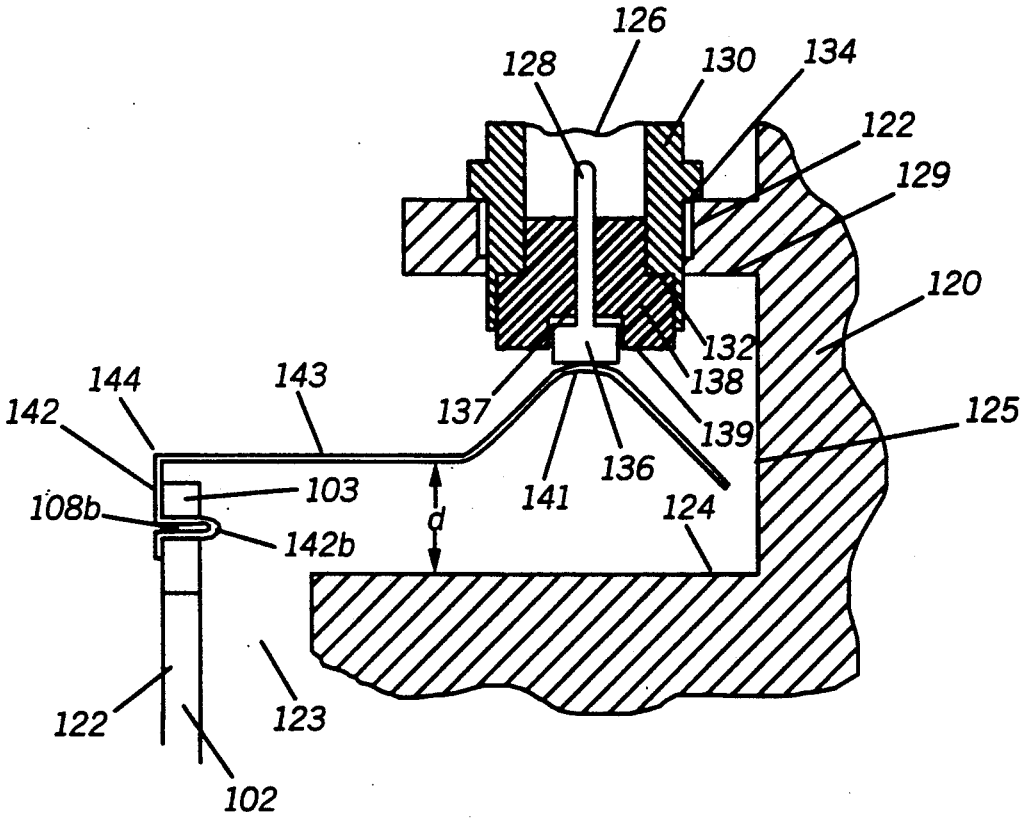
FIG. 2 is a cross-sectional view of the RF interconnect of FIG. 1 already assembled.

In addition, the casting 120 also includes a printed circuit board receiving area, 123 which is perpendicular to and spaced away from the antenna aperture 122 by a surface 124 which is more easily seen in FIG. 2. The surface 124 serves as a ground plane and in combination with a sidewall 125 and the top surface 129, form a recessed portion of the casting to house or receive an RF interconnect 140..

Preferably, the RF interconnect or contact spring 140 is a formed sheet metal or copper spring which is gold plated to provide an optimum electrical contact. The formed sheet metal spring 140 is spring shaped or integrally formed into functional segments: a base support portion 142 and a spring loaded portion comprising a contact portion 141 and an intermediate joining section 143. Located at the free end of the RF interconnect 140, the contact portion 141 has a "J" shaped bend or curve to flexibly or resiliently engage the pin contact head 136 and provides contact wiping action at the same time. In this example, the base portion 142 comprises two "V" shaped spring legs or clips 142*a* and 142*b* which are located at the other end of the interconnect 140 and are inserted into and soldered to the plated through-holes 108*a* and 108*b* of the printed circuit board 102 to be rigidly fixed. The "J" shaped bend or curve in the flexible attaching segment 141 allows the interconnect or RF contact spring 140 to flex in the direction towards the antenna terminal or connector 126. The two base legs 142*a–b* are in substantially parallel arrangement and are joined together to the spring loaded contact portion 141 by the joining section 143. The intersection between the base portion 142 and the joining section 143 forms a substantially greater than right angle bend or spring form 144 at the fixed end of the RF contact spring 140.

Referring to FIG. 2, the printed circuit board 102 is secured to the frame or casting 120 within the printed circuit board receiving area 123 but having the PCB projection 103 slightly extend beyond the printed circuit board receiving area 123 and above the surface 124 of the casting 120. In attaching the printed circuit board 102 to the antenna terminal 126 (which is already positioned onto the frame or casting 120), the spring loaded contact portion 141 resiliently biases against the contact head 136 of the antenna terminal 126 as the printed circuit board 102 (where the RF contact spring legs 142*a–b* are already soldered onto the printed circuit board 102) is positioned within the casting 120. The intersection between the joining section 143 and the base portion 142 of the RF contact spring 140, or the spring form 144, now forms an angle slightly smaller than the original angle when the RF contact spring 140 was free or unloaded to generate a spring loaded force on the contact head 136. This spring loaded force thereby electrically connects the inner conductor 128 and the antenna contact head 136 with the electrical circuit pattern of the printed circuit board 102.

If the casting 120 and the printed circuit board 102 are misaligned, the widths of the spring loaded contact portion 141 and the contact head 136 allow a good contact to be formed regardless of the particular point on the contact head 136 and the contact portion 141 that the contact is made. In addition, this spring loaded action adjusts for dimensional variations and the distance between the contact head 136 and the surface 124 of the casting 120.

Referring both to FIGS. 1 and 2, the RF contact joining section 143 is a substantially flat conductor acting as a transmission line. Its width w is predetermined or calculated to provide a specific impedance transmission line between the antenna terminal 126 and the radio circuit 109 on the printed circuit board 102. Thus, the width w of the joining section 143 is dependent upon the distance d of the joining section 143 from the ground plane which in this case is provided by the bottom surface 124 of the casting 120. Obviously, any other metal plane could also serve as the ground plane.

It is to be appreciated that the printed circuit board does not have to be located with respect to the antenna terminal 126 in this particular manner. Accordingly the base portion of the RF contact spring can be configured in other suitable manner to fit the desired arrangement.

In summary, the formed sheet metal spring which has a width calculated to provide a constant impedance transmission line between an antenna terminal and the printed circuit board results in lower manufacturing cost for any product or application requiring an RF interconnect. One application requiring a good RF interconnect is for the RF connection between the external antenna and the final power amplifier output (RF out) located on a printed circuit board of a radio which must maintain the characteristic impedance of the design for the antenna to operate optimally.

What is claimed is:

1. An RF interconnect assembly, comprising:

a ground plane;

a radio circuit;

an RF connector having a center conductor and a ground conductor, said ground conductor coupled to the ground plane;

a spring contact located a predetermined distance above parallel, and external to the ground plane and in spaced relationship with the ground plane to provide a transmission line connection between the RF connector and the radio circuit and to resiliently urge the center conductor of the RF connector in a direction substantially perpendicular to the ground plane; and air dielectric means including an air space positioned between the spring contact and the ground plane, wherein the spring contact and the ground plane comprise a transmission line.

2. The RF interconnect assembly of claim 1 wherein the ground plane is positioned perpendicular to the radio circuit.

3. The RF interconnect assembly of claim 1 wherein the ground plane is positioned external to the spring contact.

4. An RF interconnect assembly for interconnecting a circuit substrate, located within a metal casting having a ground plane, to an RF connector, mounted on the casting, the RF interconnect assembly comprising:

a base rigidly fixed to said circuit substrate;

a spring loaded contact for resiliently contacting said RF connector;

an intermediate joining section, for connecting to said spring loaded contact, and to said base;

air dielectric means including an air space positioned between the intermediate joining section and the ground plane, wherein the intermediate joining section and the ground plane comprise an intermediate transmission line, wherein the intermediate transmission line is connected in-line with the spring loaded contact; and a spring form provided by an intersection of said base with said intermediate transmission line, to spring load said spring loaded contact resiliently against said RF connector and to resiliently urge a center conductor of the RF connector in a direction substantially perpendicular to the ground plane.

5. The RF interconnect assembly of claim 4 wherein said base, said spring loaded contact, and said intermediate transmission line are integrally formed as a single part, without including the ground plane, and spring shaped from sheet metal.

6. The RF interconnect assembly of claim 4 wherein said base, said spring loaded contact, and said intermediate transmission line are integrally formed as a single part, without including the ground plane, and spring shaped from copper.

7. An RF interconnect contact assembly for interconnecting a radio circuit to an RF connector in a radio, comprising:

a circuit substrate for forming said radio circuit;

supporting means supporting said circuit substrate and having a ground plane surface; and an RF spring contact including first and second opposed end portions and an intermediate portion, said intermediate portion having a fixed end and a free end, said first end portion being rigidly fixed to said circuit substrate; said second end portion resiliently contacting said RF connector;

an intersection of said first end portion with said intermediate portion forming a spring form, at the fixed end, to spring load said second end portion resiliently against said RF connector, at the free end;

said intermediate portion located a predetermined distance above said ground plane surface to provide a transmission line, having a fixed end and a free end, for connection between said RF connector, at the free end, substantially linear with the second end portion, and said radio circuit, at the fixed end; and air dielectric means including an air space positioned between the intermediate section and the ground plane surface, wherein the intermediate section and the ground plane surface comprise said transmission line substantially linear with the second end portion.

8. The RF interconnect contact assembly of claim 7 wherein said intermediate portion has a width dependent upon the distance of said intermediate portion from said ground plane to provide a microstrip as one form of said transmission line.

9. The RF interconnect contact assembly of claim 7 wherein said first end portion forms a corner bend with the intermediate portion.

10. The RF interconnect contact assembly of claim 7 wherein said supporting means comprises a metal casting for said radio having the ground plane surface perpendicular to the circuit substrate.

* * * * *